US005156237A

United States Patent [19]

Hayashi et al.

[11] Patent Number: 5,156,237

[45] Date of Patent: Oct. 20, 1992

[54] ELEVATOR LANDING DOOR APPARATUS

[75] Inventors: Yoshikatsu Hayashi; Masami Yoshikawa; Makoto Tomidokoro, all of Inazawa; Masaaki Murakami; Tetsuro Ogushi, both of Amagasaki; Yutaka Noda, Nagoya, all of Japan

[73] Assignee: Mitsubishi Denki Kabushiki Kaisha, Tokyo, Japan

[21] Appl. No.: 767,629

[22] Filed: Sep. 30, 1991

[30] Foreign Application Priority Data

Oct. 1, 1990 [JP] Japan ..... 2-263519

[51] Int. Cl.[5] ..... B66B 9/00

[52] U.S. Cl. ..... 187/1 R; 187/51; 49/120; 52/809

[58] Field of Search ..... 187/1 R, 51, 56; 49/116, 120, 399, 309, 504; 52/30, 809, 785

[56] References Cited

U.S. PATENT DOCUMENTS

| | | | |
|---|---|---|---|
| 3,631,942 | 1/1972 | Brown | 187/1 R |
| 4,282,687 | 8/1981 | Teleskivi | 49/503 |
| 4,530,189 | 7/1985 | Randall | 187/1 R |
| 4,735,293 | 4/1988 | Everhart et al. | 187/56 |

FOREIGN PATENT DOCUMENTS

| | | |
|---|---|---|
| 3502032 | 1/1984 | Fed. Rep. of Germany . |
| 2610311 | 4/1987 | France . |
| 61-75189 | 5/1986 | Japan . |

*Primary Examiner*—Robert P. Olszewski
*Assistant Examiner*—Kenneth Noland
*Attorney, Agent, or Firm*—Leydig, Voit & Mayer

[57] ABSTRACT

An apparatus operable on each elevator platform for opening or closing doors wherein the apparatus includes a pair of doors for opening or closing an inlet/outlet on the elevator platform, a rail for guiding the rolling movement of rollers carried by a hanger plate standing upright on the upper surface of each door and a door-sill arranged below said inlet/outlet for guiding the slidable movement of a door shoe at the lower end of each door. Each door is essentially composed of a door main body having a vertically extending reinforcement member for supporting the dead weight of each door and a thermal insulating panel fixedly secured to the door main body on the elevator platform side, the thermally insulating panel being filled with a thermal insulating material, and a decorative plate is adhesively secured to the front surface of the thermal insulating panel on the elevator platform side.

2 Claims, 4 Drawing Sheets

ELEVATOR LANDING DOOR APPARATUS

BACKGROUND OF THE INVENTION

The present invention relates to an elevator landing door apparatus, and, more particularly, it relates to improvements on the construction of a fire-resistant door for an elevator landing zone.

FIG. 6 and FIG. 7 illustrate a conventional elevator landing door apparatus disclosed in such references as the official gazette on utility model laid open, No. 148685-1988 (Showa 63). In these drawings, the reference number (1) denotes a doorway for the elevator landing, and this doorway (1) is provided with three-side frames (2), and a sill (4) is laid down on the landing zone floor (3) in the above-mentioned doorway (1). The three-side frames (2) mentioned above are comprised of a pair of mutually opposing vertical frames (2*a*) and an upper frame (2*b*) suspended horizontally between the upper parts of this pair of vertical frames (2*a*). Also, a groove (4*a*) is made in a concave formation in the longitudinal direction on the upper surface of the sill (4) as illustrated in FIG. 7. The reference number (5) indicates a plural number of doors for opening and closing the doorway (1), and this door (5) is provided with a surface plate (6) which has a section approximately in a groove shape and forms a decorated surface, as shown in FIG. 7, vertical reinforcing members (7) having a section approximately in the shape of a hat and welded vertically onto the side of this surface plate (6), namely, the side opposite to the decorated surface, and a back plate (9) covering the opening in the back surface of the surface plate (6) at the side of the elevator shaft (8) and set with a screw in the vertical reinforcing material (7). The reference number (10) indicates a hanger plate which is installed in an upright position in the upper part of the doors (5). On the elevated section of this hanger plate (10), a plural number of rollers (11) are mounted each with a pivot in a such a manner as to o permit their rotating motion, as shown in FIG. 6. The reference number (12) indicates a rail which is mounted horizontally on the wall at the side of the elevator shaft (8) and is thus positioned above the upper frame (2*b*), and this rail (12) is so arranged that it engages and guides the above-mentioned rollers (11). Then, the reference number (13) indicates a plural number of door shoes fitted out to the lower part of the door (5), and these door shoes (13) are inserted with free play into the above-mentioned groove (4*a*) in such a manner as to permit their free sliding motion therein and to be guided accordingly.

Therefore, the doors (5) will move smoothly to open and to close the doorway (1), being guided by the rail (12) and the (groove (4*a*), on the basis of their engagement with the doors (now illustrated) for the elevator cab.

In this regard, the conventional art literature of this kind include the official gazette on utility model laid open, No. 31188-1980 (Showa 55) and No. 29025-1984 (Showa 59), official gazette on patent laid open, No. 75189-1986 (Showa 61), and U.S. Pat. No. 4,282,687 in addition to the official gazette cited above.

Since the conventional apparatus is constructed in the above-described manner such that each door 5 is essentially composed of a surface plate 6, a vertically extending reinforcement member 7 and a back plate 9, there appears a problem that a temperature on the rear surface of the door 5 is undesirably elevated in the event of a fire, whereby instruments in an elevator cage are damaged or, in an extreme case, persons staying in the elevator cage are exposed to serious danger. In practice, a gap between the periphery of the doorway 1 and the doors 5 serves to smoothen the opening/closing of each door 5 (see FIG. 7). However, once a fire takes place, the foregoing gap permits undesirable inflow of smoke from the elevator landing zone into the elevator shaft 8 serving also as a kind of chimney, resulting in damage induced by the fire being enlarged extensively.

SUMMARY OF THE INVENTION

The present invention has been made with the foregoing background in mind and its object resides in providing an apparatus operable on each elevator landing zone for opening or closing doors wherein damage or breakage of instruments, equipments or the like arranged in a raising/lowering passage, i.e. an elevator shaft, in the event of a fire can reliably by prevented, and moreover, life safety of each person staying in an elevator cage can be improved substantially.

To accomplish the above object, there is provided according to one aspect of the present invention an apparatus operable on each elevator platform, i.e. each elevator landing zone, for opening or closing doors wherein the apparatus includes a pair of door for opening or closing an inlet/outlet on the elevator platform, a rail for guiding the rolling movement of rollers carried by a hunger plate standing upright on the upper surface of each door and a door-sill arranged below the inlet/-outlet for guiding the slidable movement of a door shoe at the lower end of each door, wherein each door is essentially composed of a door main body having a vertically extending reinforcement member for the purpose of supporting the dead weight of each door incorporated therein and a thermal insulating panel fixedly secured to the door main body on the elevator platform side the thermal insulating panel being filled with a thermal insulating material, and wherein a decorative plate is adhesively secured to the front surface of the thermal insulating panel on the elevator platform side.

In addition, according to other aspect of the present invention, there is provided an apparatus operable on each elevator platform for opening or closing doors wherein the apparatus includes a pair of doors for opening or closing an inlet/outlet on the elevator platform, a rail for guiding the rolling movement of rollers carried by a hunger plate standing upright on the upper surface of each door and a door-sill arranged below the inlet/-outlet for guiding the slidable movement of a door shoe at the lower end of each door, wherein the interior of each door on the raising/lowering passage side is filled with a thermal insulating material, and wherein the interior of each door on the elevator platform side is filled with another thermal insulating material having excellent heat resistance more than that of the thermal insulating material on the raising/lowering passage side.

According to the present invention, each door located on each elevator platform is constructed in a multi-layered structure including a door main body having a vertically extending reinforcement member for the purpose of supporting the dead weight of the door main body incorporated therein and a thermal insulating panel fixedly secured to the surface of the door main body on the elevator platform side and having a thermal insulating material filled therein. In addition, a decorative plate having a beautiful design appearing thereon is adhesively secured to the surface of the thermal insulating panel on the elevator platform side. With such construction as mentioned above, the apparatus of the present invention assures that damage or breakage of instruments, equipments or the like arranged in the raising/lowering passage can reliably be prevented, and moreover, life safety of each person staying in an elevator cage can be improved substantially.

DETAILED DESCRIPTION OF THE PREFERRED EMBODIMENTS

Figure 1:
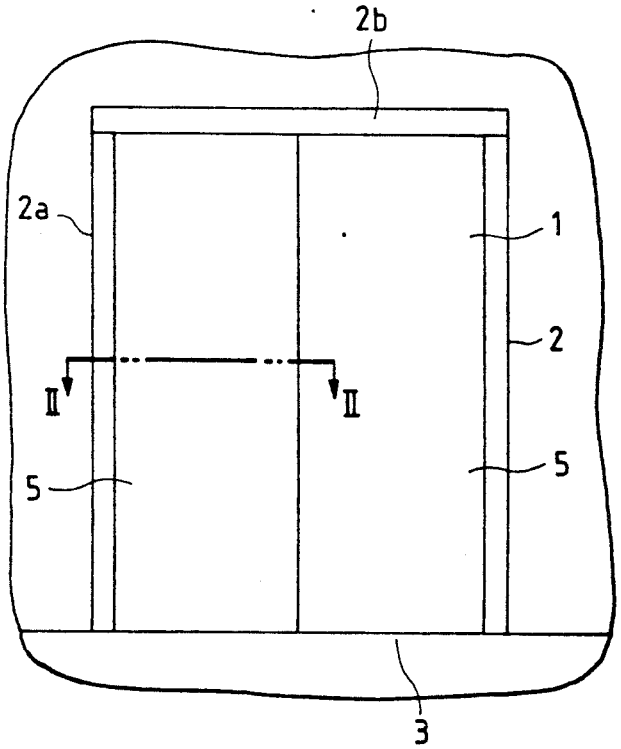
FIG. 1 is a front view of an apparatus operable on each elevator platform for opening or closing doors in accordance with an embodiment of the present invention as seen from the elevator platform side.

In the subsequent part, the elevator landing door apparatus according to the first aspect of the present invention will be described in detail on the basis of the examples of preferred embodiments thereof illustrated in FIG. 1 through FIG. 5. In these drawings, the reference number (5) indicates a door for opening and closing the doorway (1), and, as shown in FIG. 2, this door (5) is constructed in a thick structure comprised of multiple layers formed of a main unit (14) of the door and a heat insulating panel (16) having an approximately groove-shaped section and installed rigidly on the surface of this main unit of the door on the side of the elevator landing zone with a plural number of mounting metal fittings (15), and thus the door is capable of attaining a quite considerable heat insulating effect.

Figure 2:
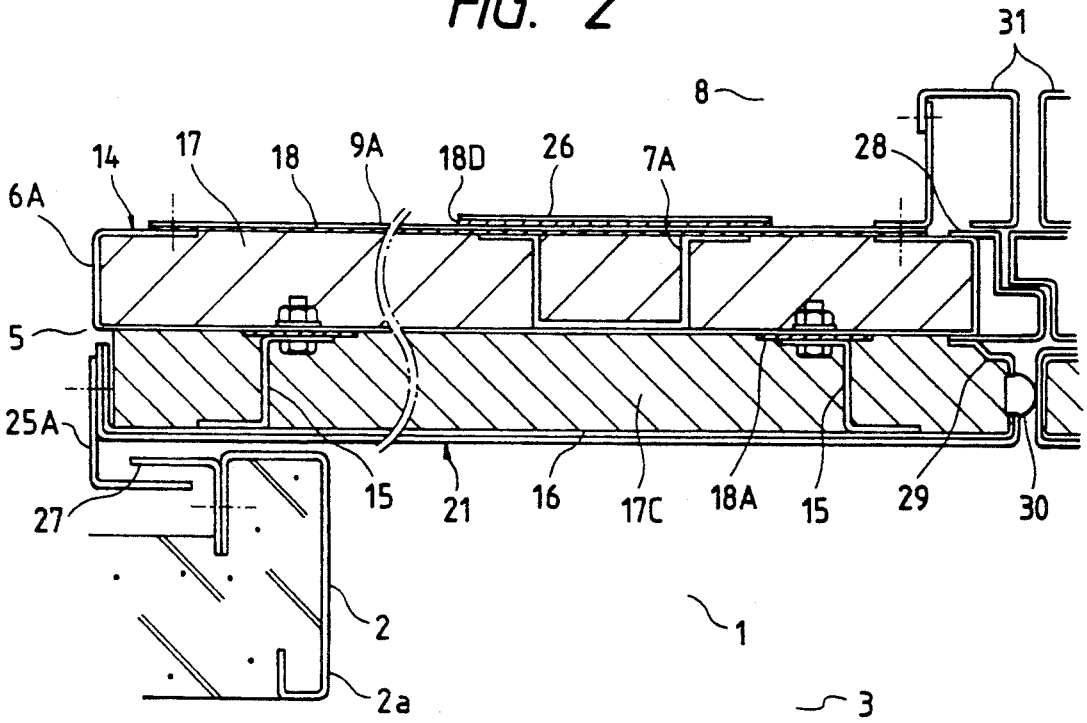
FIG. 2 is a fragmentary sectional view of the apparatus taken along line II—II in FIG. 1.
Figure 4:
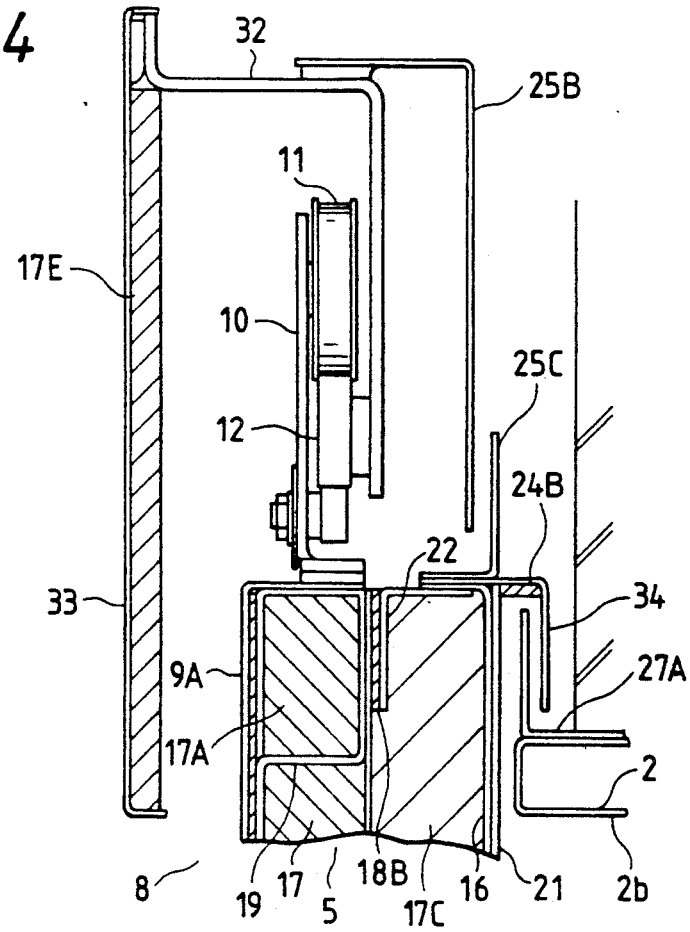
FIG. 4 is a fragmentary vertical sectional view of the apparatus, particularly illustrating arrangement of the upper parts of the doors and the apparatus.
Figure 5:
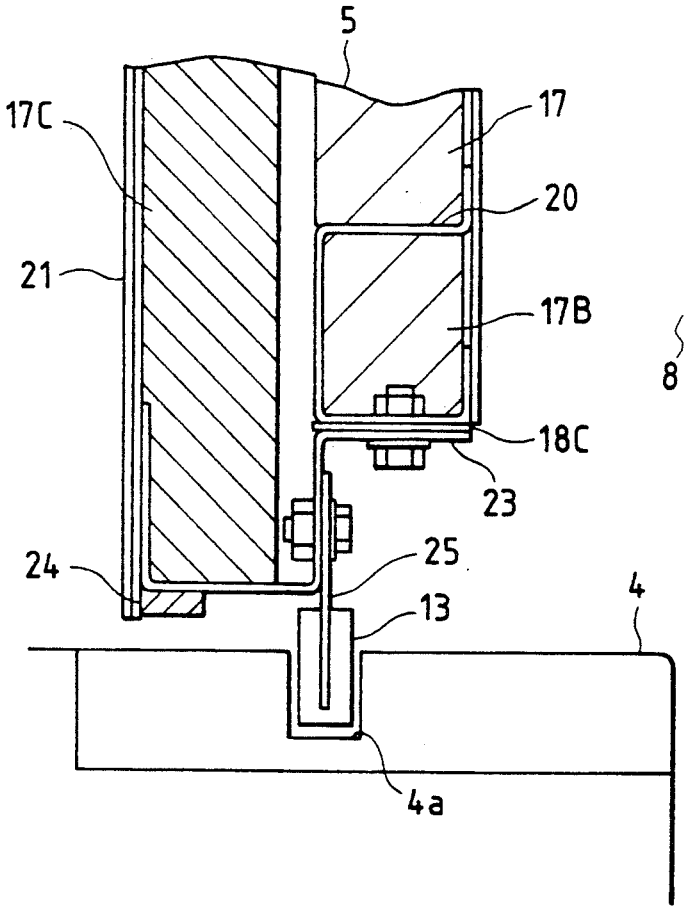
FIG. 5 is a fragmentary vertical sectional view of the apparatus, particularly illustrating the lower part of the door.
Figure 6:
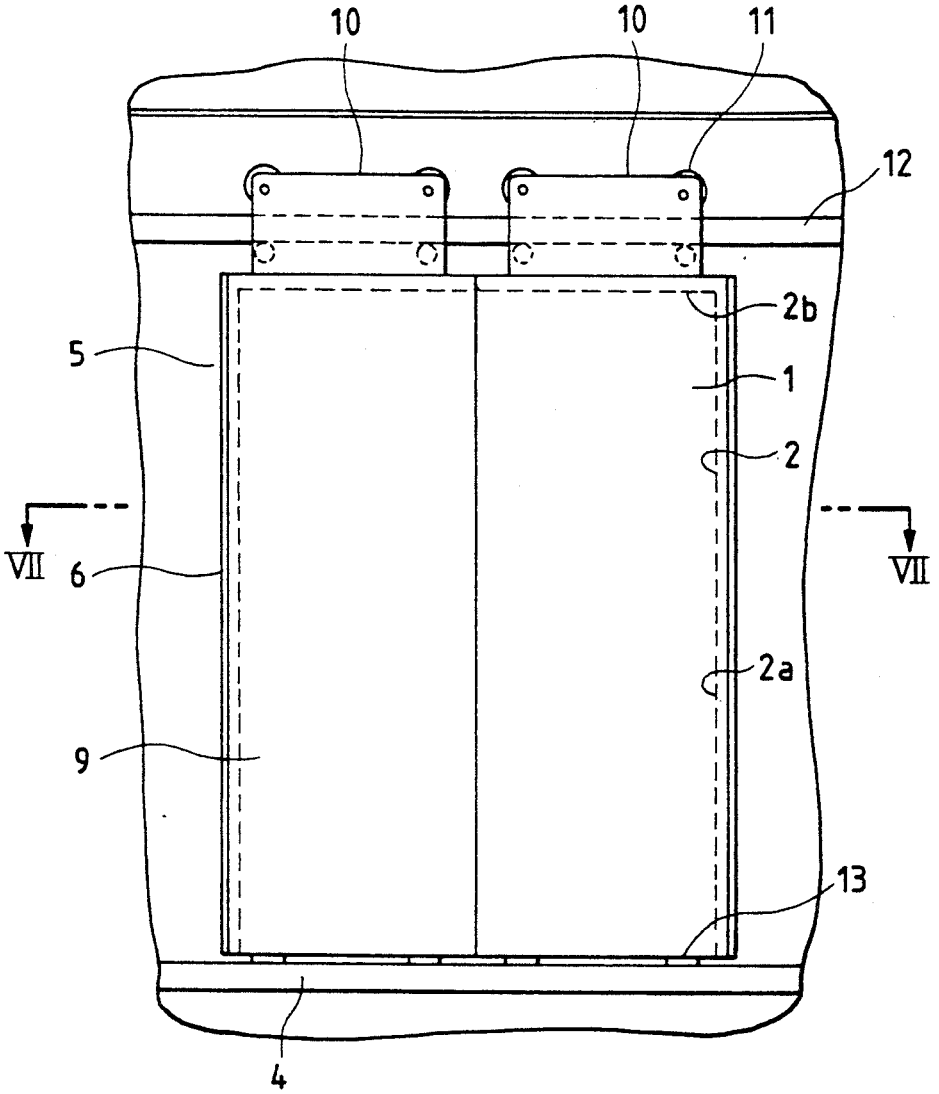
FIG. 6 is a rear view of a conventional apparatus operable on each elevator platform for opening or closing doors.
Figure 7:
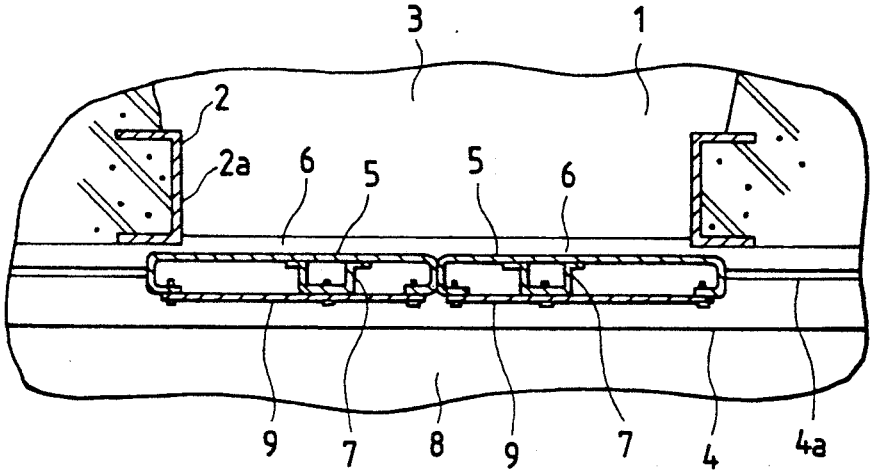
FIG. 7 is a sectional view of the conventional apparatus taken along line VII—VII in FIG. 6.

The above-mentioned main unit (14) of the door is provided, as shown in FIG. 2, with a surface plate (6A) in an approximately groove-shaped section, a vertical reinforcing material (7A) formed in an approximately hat-shaped section and welded in an upright position almost in the center of the inside area of this face plate (6A) and having strength necessary for supporting the self-weight of the door (5) and also for enabling the door (5) to perform its smooth opening and closing operations, and a back plate (9A) installed in such zo a manner as to cover the opening in the back surface of the surface plate (6A), namely on its surface at the side of the elevator shaft (8), and heat insulating material (17) which places restraint on the conduction of heat to the back surface of the door (5) is inserted in the inside area of the main unit of the door. A heat insulating sheet (18), which reduces the amount of heat conducted between metals, is placed in its interposition between the surface plate (6A) mentioned above and the vertical reinforcing material (7A) and the back plate (9A). Also, the upper part of the back plate (9A) is formed in an inverted L-letter shape by its horizontal bending as illustrated in FIG. 4, so that the strength of the upper part of the door (5) is thereby increased. Further, the back plate (9A) and the surface plate (6A) are connected through an oblong hole, so that it is made possible to prevent a deformation like that of bimetal which is caused by temperature differences among various component parts at the time of a fire. Moreover, an upper part reinforcing member (19) is fixed in the upper part of the main unit (14) of the door as shown in FIG. 4, and this upper part reinforcing member (19), being thus positioned above the doorway (1), is so constructed as to place restraint on the rise of temperature in the upper area of the door (5) and also to support the self-weight of the door (5). In this regard, heat insulating material (17A), which restrains thermal conduction in the upper area of the door (5), is inserted in the upper part reinforcing member (19). Additionally, a lower part reinforcing member (20) is provided in the lower part of the main unit (14) of the door as shown in FIG. 5, and heat insulating material (17B) is inserted in the inside area of this lower part reinforcing member (20).

On one hand, the mounting metal fittings (15) are formed in a section in an approximately Z-letter shape as shown in FIG. 2 in an effort to reduce their area of metal contact, and one end part is mounted with a screw applied with a tightening tool on the surface of the surface plate (6A) while the other end part is fixed on the inside surface of a heat insulating panel (16), and the route for the conduction of heat from the heat insulating panel (16) to the main unit (14) of the door is thus extended to form a construction which places restraint on a rise of temperature on the surface of the elevator shaft (8). Also, a heat insulating sheet (18A), which cuts off the heat otherwise conducted from the mounting metal fittings (15) to the surface plate (6A) is arranged in its interposition between one end part of the mounting metal fittings (15) and the surface plate (6A).

On the other hand, the heat insulating panel (16) is finished with a decorated plate (21), which has excellent shaped section, covering the front surface of the above-mentioned panel on the side of the elevator landing zone, as shown in FIG. 2, and heat insulating material (17C) is inserted between the surface plate (6A) and the decorated plate (21). The decorated plate mentioned above and the heat insulating panel (16) are connected through an oblong hole and thereby form a construction capable of preventing a deformation like that of bimetal caused by differences in temperature among various component parts at the time of a fire. Moreover, the heat insulating material (17C) mentioned above is composed of expensive materials superior in heat resistance to the heat insulating material (17) mentioned above and is accordingly made to achieve a heat insulating effect more effectively in the heat insulating panel (16), which is exposed to a high temperature at the time of a fire. Moreover, this heat insulating material (17C) is formed into cotton-like heat insulating material scarcely liable to the growth of a gap in the parts of the material positioned on both sides while the material positioned in the central part thereof is formed into a board-shaped heat insulating material convenient for the assembly work, the respective parts of the material being inserted to form the arrangement mentioned above. Moreover, the heat insulating panel (16) is formed in such a manner that both sides thereof form a gap for restraining a rise in the temperature on the surface of the elevator shaft (8). Then, upper part mounting metal fittings (22) in the shape of an inverted L letter, which are positioned above the doorway (1), are fixed rigidly in the upper part of the heat insulating panel (16), as shown in FIG. 4, and this upper part mounting metal fittings (22) are fixed rigidly in the upper part of the surface plate (6A) by way of the heat insulating sheet (18B). Moreover, the lower part of the heat insulating panel (16) is positioned below the lower part of the main unit (14) of the door as shown in FIG. 5, and a lower part mounting plate (23) is suspended between the lower part of the heat insulating panel (16) and the lower part reinforcing material (20), and a heat insulating sheet (18C) is arranged in interposition between this lower part mounting plate (23) and the lower part reinforcing member (20). As shown in FIG. 5, the lower part mounting plate (23) is provided with expansive material (24) which, being set on the bottom part positioned above the lower end of its decorated plate (21), expands by the effect of heat at the time of a fire and thereby closes up the clearance (C) between the sill (4) and the clearance (C), and has a heat rectifying plate (25) mounted with a screw on the jogged part on its upright area, and a door shoe (13), which is to be inserted in a freely movable state into a groove (4*a*), is installed on the lower part of this heat rectifying plate (25). Therefore, the door shoe (13) will be position in the proximity of the center of gravity for the door (5). Moreover, the heat rectifying plate (25) mentioned above and the groove (4*a*) are constructed so as to form a halving joint structure.

The reference number (26) indicates a high temperature zone cover mounted on the back plate (9A), and, as shown in FIG. 2, a heat insulating sheet (18D), which is positioned to face the vertical reinforcing member (7A) and cuts off the heat conducted via the vertical reinforcing member (7A) with high thermal conductivity, is placed in interposition between this high temperature zone cover (26) and the back plate (9A). This example of preferred embodiment, moreover, shows a construction in which the heat insulating sheet (18D) is arranged in a position where it faces the vertical reinforcing member (7A), but the part which is to face the sheet insulating sheet (18D) will not be limited to this vertical reinforcing member (7A) so long as such a part is one having high thermal conductivity.

Figure 3:
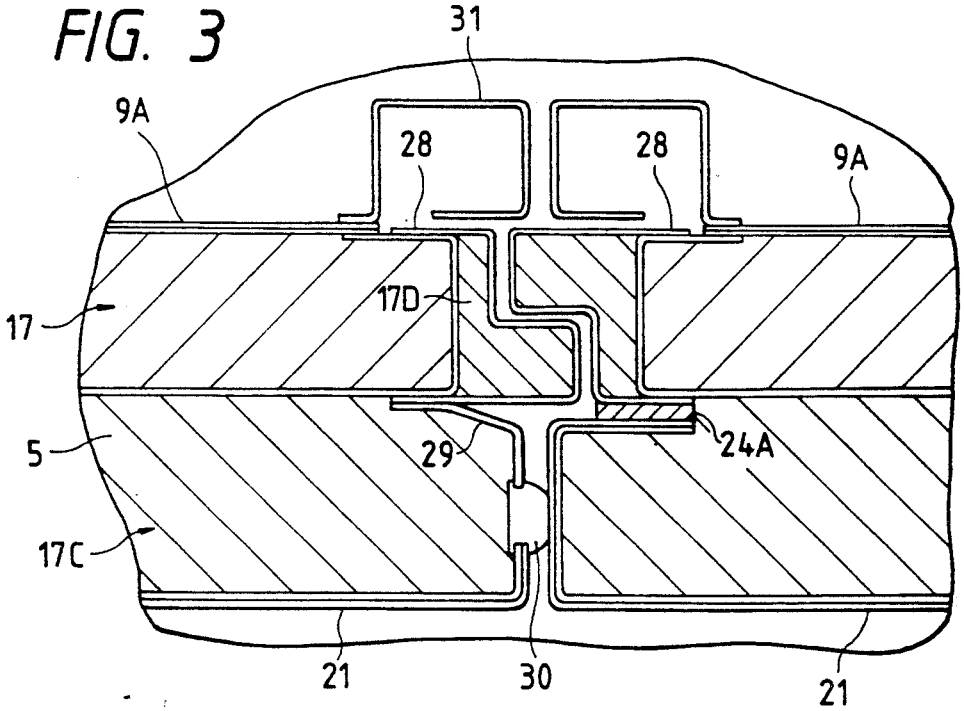
FIG. 3 is an enlarged fragmentary sectional view of the apparatus, particularly illustrating the structure of a door contact section appearing when the doors are closed.

The reference number (25A) indicates a heat insulating plate which has a section in an approximately L-letter shape and is mounted on one side of the decorated plate (21) on the shutter box side, and the reference number (27) indicates a plate having a section in an approximately L-letter shape and mounted on a vertical frame (2*a*) of the three-side frames (2), and this plate (27) and the heat insulating plate (25A) together form a halving joint structure, being lapped with each other at the time of a closure of the door (5), so that it prevents smoke accompanied with heat from flowing into the elevator shaft (8) through the clearance (C) of the door (5). The reference number (28) indicates a door stopping plate mounted on each of the door stopper parts facing each other in close proximity in the main units (14) of the door (14) and (14), and this door stopping plate (28) is provided with heat insulating material (17D) inserted in the inside area thereof and producing a heat insulating effect, as shown in FIG. 2 and FIG. 3, and these door stopping plates (28) approach each other to be positioned side by side in proximity, with a clearance left between them, being lapped with each other and thereby forming a halving joint structure, when the door (5) is closed, and these door stopping plates (28) are constructed to place restraint on the amount of smoke accompanied with heat which will flow into the elevator shaft (8) from the door stoppers. Additionally, the door stopping plates (28) are arranged, by virtue of its construction, in such a manner that the stroke of the left door (5) and that of the right door (5) are made equal with their face measure center being set to deviate from the center of the actual doorway (1). The reference number (29) indicates is a metal clamper mounted on the surface on the elevator landing zone side of the door stopping plate (28) which is positioned on the left side in the illustration given in FIG. 3, and a door stopping rubber (30), which has an approximately semicircular section and set along the overall length in the longitudinal direction of the door (5), is held between this metal clamper (29) and the decorated plate (21), these forming a construction in which this door Istopping rubber (30) is brought into its direct contact with the decorated plate (21) on the right side in the illustration given in FIG. 3 when the door (5) is closed. The reference number (24A) indicates expansive material interposed between the door stopping plate (28) and the decorated plate (21), and 20 this expansive material (24A) will expand with heat at the time of a fire and closes the clearance between the decorated plate (21) on the right side of the illustration given in FIG. 3 and the door stopping plate (28) on the left side of the same illustration, thereby preventing smoke accompanied with heat from flowing into the elevator shaft (8) through the clearance mentioned above.

The reference number (31) indicates a blind plate mounted on the back plate (9A), and this blind plate (31) is formed with a section in an approximately square pipe shape and positioned on the side of the door stopping plate (28) facing the elevator shaft (8), as illustrated in FIG. 3, and is so constructed that it guides air, which will achieve a cooling effect, in the vertical direction.

The reference number (10) indicates a hanger plate mounted in an upright position on the upper part of the back o plate (9A), which forms a part of the main unit (14) of the door, and this hanger plate (10) has rollers (11) capable of performing rotating motion and forming a construction in which they are engaged and guided by a rail (12) which suspends the door in the vicinity of its center of gravity. The reference number (32) indicates a hanger case which has this rail (12) and the landing door apparatus and so forth built in it, and this hanger case (32) has holes made in the upper part on the side of the elevator shaft (8) for discharging a heat flow which has flown into the inside area of the hanger case, and heat insulting material (17E) is fitted out on the inner surface of a hanger case cover (33) as illustrated in FIG. 4. Also, a heat rectifying plate (25B) in an inverted L-letter shape is installed, aloof from the hanger case (32), on the upper part of the hanger case (32) on the side of the wall of the elevator shaft (8), and holes for discharging a heat flow which has flown into the inside area of the hanger case (32) are made through the upper part of this heat rectifying plate (25B). The reference number (34) indicates an upper halving joint plate in an inverted L-letter shape, which is mounted on the upper part of the heat insulating panel (16) and positioned above the upper frame (2*b*) of the three-side frames (2), and this upper part halving joint plate (34) is made in a width size larger than that of the door (5). The reference number (27A) indicates a plate formed in an L-letter shape and installed in an upright position on the upper frame (2*b*), and this plate (27) and the upper part halving joint plate (34) are lapped with each other and form a halving joint structure when the door (5) is closed, as shown in FIG. 4, so that the halving joint structure thus formed prevents smoke accompanied with heat from flowing into the elevator shaft (8) through the clearance (C) between the upper frame (2*b*) and the door (5). Then, expansive material (24B) is fitted out on the upper part of the inside area of the upper part halving joint plate (34) mentioned above, so that the expansive material (24B) expands with the heat generated at the time of a fire, thereby forming a closure in the clearance between the upper part halving joint plate (34) and the plate (27A). Moreover, a heat rectifying plate (25C) in an L-letter shape is mounted in an upright position on the upper part of the upper part halving joint plate (34), and this heat rectifying plate (25C) and the heat rectifying plate (25B) together form a halving joint structure, being lapped with each other at the time of a closure of the door (5), as shown in FIG. 4, so that the structure thus formed inhibits smoke accompanied with heat from flowing into the inside area of the hanger case (32).

With such construction as described above, since the heat insulting panel 16 having a heavy thickness is secured to the surface of the door main unit 14 in a multi-layered structure, the door 5 has a highly increased thermal insulating effect. This leads to the result that reduction of a strength of the door 5 is substantially suppressed with remarkably improved life safety of each person staying in an elevator cage while preventing damage or breakage of instruments or equipments arranged in the elevator shaft 8.

Since the upper part reinforcement member 19 including the heat insulating material 17A located above the doorway 1 is fixedly secured to the door main unit 14, undesirable elevation of a temperature in the region above the door 5 and the elevator shaft 8 can substantially be suppressed in the event of a fire.

In addition, since the door main unit 14 and the heat insulating panel 16 are fixed to each other via the substantially Z-shaped small mounting metal fittings 15, a heat conduction length by way of which heat is conducted from the heat insulating panel 16 to the door main unit 14 via the fixing region can be elongated, resulting in undesirable elevation of a temperature in the elevator shaft 8 being suppressed remarkably. It should be added that the mounting metal fittings 15 are arranged in the interior of the heat insulating panel 16.

Additionally, since the surface plate 6A, the back plate 9A, the heat insulating panel 16 and the decorative plate 21 are coupled to each other via elongated holes (not shown), bimetal-shaped deformation attributable to temperature difference appearing on the respective members in the event of a fire can be prevented reliably.

Further, since each door 5 is composed of the door main unit 14 and the heat insulating panel 16 each having a heavy thickness, and moreover, the position where the door 5 is suspended from the rail 12 is located in alignment with the gravity center of each door 5, a moment exerted on the door shoe 13 is reduced substantially. This assures a smooth opening/closing operation of the doors 5.

Furthermore, since a certain gap is formed between the door main unit 14 and the decorative plate 21 along the outer side wall of the door 5 as shown in FIG. 2, heat conduction can be minimized, and moreover, undesirable elevation of a temperature in the elevator shaft 8 can be suppressed substantially.

Finally, since the very expensive thermal insulating material 16C having excellent heat resistance is filled only in the heat insulating panel 16 which is unavoidably exposed to an elevated temperature in the event of a fire, this makes it possible to minimize a production cost of the apparatus.

As described above, according to the present invention, since a heat insulating panel having a heavy thickness is arranged on the door main unit in a multi-layered structure, each door has a very high thermal insulating effect. This assures that reduction of a strength in the event of a fire can substantially be suppressed, damage or breakage of instruments, equipments or the like arranged in the elevator shaft can reliably be prevented and life safety for each person staying in an elevator cage can be improved remarkably.

In addition, since an upper part reinforcement member including a thermal insulating material located above the doorway is fixedly secured to the upper surface of a door main unit, this makes it possible to substantially suppress undesirable elevation of a temperature in the region above the doors and the elevator shaft in the event of a fire.

Additionally, since the door main unit and the heat insulating panel are connected to each other via mounting metal fittings each having a Z-shaped sectional contour located at the connecting portions, the heat transmission passagey by way of which heat is transmitted from the heat insulating panel to the door main unit viat the connecting portions can be elongated so as to substantially suppress undesirable elevation of a temperature in the elevator shaft in the event of a fire.

Further, since the surface plate, the back plate, the heat insulating panel and the decorative plate are connected to each other via elongated holes, this makes it possible to reliably suppress their bimetal-shaped deformation due to temperature difference appearing across the respective members in the event of a fire.

Further, since each door is essentially composed of a door main unit and a heat insulating panel while having a heavy thickness, a magnitude of moment exerted on the door shoe can remarkably be reduced, resulting in smooth opening/closing movement of the doors being assured.

Furthermore, since a certain gap is formed between the door main unit and the decorative plate on their outer end side, undesirable elevation of a temperature in the elevator shaft in the event of a fire can substantially suppressed owing to effective suppression of heat transmission through them.

Finally, since only the heat insulating panel exposed to an elevated temperature in the event of a fire is filled with a very expensive thermal insulating material having excellent heat resistance, this makes it possible to minimize a production cost of the apparatus of the present invention.

What is claimed is:

1. An elevator landing door apparatus comprising:

a door for opening and closing the doorway at an elevator landing zone, including a main unit retaining therein vertical reinforcing members for supporting the self-weight of the door and a heat insulating panel installed rigidly on the surface of the main unit of the door facing the elevator landing zone side and filled up with heat insulating material in the inside area thereof;

a rail for guiding the rollers of a hanger plate installed in an upright position in the upper part of the door defined above;

a sill for guiding a door shoe set in the lower part of the door laid out in the lower part of said doorway; and a decorative plate adhesively secured to the front surface of the heat insulating panel on the elevator platform side.

2. An elevator landing door apparatus comprising:

a door for opening and closing the doorway at an elevator landing zone;

a rail for guiding the rollers of a hanger plate installed in an upright position in the upper part of said door;

a sill for guiding a door shoe set in the lower part of the door laid out in the lower part of said doorway; and wherein the interior of each door on an elevator shaft side is filled with a thermal insulating material, and the interior of each door on an elevator landing zone side is filled with another thermal insulating material having excellent heat resistance more than that of said thermal insulating material on the elevator shaft side.

* * * * *